United States Patent [19]

Christolear, Jr.

[11] Patent Number: 4,957,281

[45] Date of Patent: Sep. 18, 1990

[54] ROTATOR CUFF THERAPEUTIC EXERCISE APPARATUS

[75] Inventor: Max D. Christolear, Jr., Dayton, Ohio

[73] Assignee: Wright State University, Dayton, Ohio

[21] Appl. No.: 303,139

[22] Filed: Jan. 30, 1989

[51] Int. Cl.[5] ..... A63B 21/06

[52] U.S. Cl. ..... 272/117; 272/118; 272/134

[58] Field of Search ..... 272/116, 117, 118, 129, 272/130, 134, 617

[56] References Cited

U.S. PATENT DOCUMENTS

| | | | |
|---|---|---|---|
| 4,239,210 | 12/1980 | Lambert, Jr. | 272/118 |
| 4,349,191 | 9/1982 | Lambert, Jr. et al. | 272/118 |
| 4,349,193 | 9/1982 | Lambert, Jr. et al. | 272/118 |
| 4,456,245 | 6/1984 | Baldwin | 272/118 |
| 4,511,317 | 4/1985 | Jones | 272/118 |
| 4,533,747 | 11/1985 | Pursley | 272/118 |
| 4,563,003 | 1/1986 | Bugallo et al. | 272/118 |
| 4,621,807 | 11/1986 | Stramer | 272/117 |
| 4,637,607 | 1/1987 | McArthur | 272/129 |
| 4,666,149 | 5/1987 | Olschansky et al. | 272/116 |
| 4,711,448 | 12/1987 | Minkow et al. | 272/118 |
| 4,799,670 | 1/1989 | Williamson | 272/117 |
| 4,878,663 | 11/1989 | Luquette | 272/134 |

FOREIGN PATENT DOCUMENTS 2742106 3/1979 Fed. Rep. of Germany ..... 272/117

OTHER PUBLICATIONS

"Isolated Joint Testing & Exercise–The Handbook for Using CYBEX® II", pp. 1–30 and 55–70 (1980).

*Primary Examiner*—Robert W. Bahr

*Attorney, Agent, or Firm*—Killworth, Gottman, Hagan & Schaeff

[57] ABSTRACT

A rotator cuff therapeutic exercise apparatus is provided which includes a stack of weights supported on a frame for movement along a working stroke from a rest position against gravitational force to a displaced position and an actuator mechanism on the frame adapted to be gripped and rotated by a hand of a user to move the weights along the working stroke. The actuator mechanism is positionable in either first or second configurations for permitting a corresponding rotational working motion of the one of the user's arms whose hand grips the actuator mechanism. For transmitting the rotational motion of the user's arm to move the weights, a ratchet-type mechanism is provided which is connected to the actuator mechanism and allows internal and external rotation of the arm and for accomplishing positive and negative work therewith. A two-piece cam assembly with replacable cams is provided which is connected between the weights and the ratchet mechanism for permitting progressive (comparative) resistance exercising tailored to particular exercises.

16 Claims, 5 Drawing Sheets

ROTATOR CUFF THERAPEUTIC EXERCISE APPARATUS

BACKGROUND OF THE INVENTION

The present invention generally relates to an exercise apparatus for working muscles and, more particularly, to a rehabilitative and therapeutic exercise apparatus for working injured, surgically repaired, and healthy muscles, especially the muscle group known as the rotator cuff.

The muscle group known as the rotator cuff is comprised of the subscapularis, teres minor, infraspinatus and supraspinatus muscles. This muscle group starts on the back of the shoulder in the area of the shoulder blade and winds around the shoulder to the insertion on the ball of the shoulder joint. Contraction of this group of muscles results in the internal and external rotation of the upper arm. Over-stressing the rotator cuff during activities such as throwing a baseball or serving in tennis can result in injury thereto.

physical therapeutic measures for rehabilitation of muscle and tendon injuries have been shown to be of great value. Many hospitals are currently setting up sport medicine clinics in response to the increased demand for rehabilitation therapy. However, most equipment currently available for muscle exercise was not designed with rehabilitative therapy in mind. Representative of the muscle working or exercise equipment devised in the prior art are the apparatuses disclosed in U.S. Pat. Nos. to Lambert, Jr. et al (4,239,210; 4,349,191; and 4,349,193), Baldwin (4,456,245), Bugallo et al (4,563,003), and Jones (4,511,137).

Of the rehabilitative muscle working equipment currently available, the equipment designed for application of rehabilitation therapy to the rotator cuff is extremely limited. Thus, in most cases, free weights are used. The major drawback to free weights is that resistance (load) is dependent on position. In some cases the resistance has been reduced to zero by the time the motion is complete. Exercise machines are an improvement over free weights; however, in the case of rotator cuff, the machines which have been devised, such as Cybex II Isokinetic Exerciser and the machine disclosed in U.S. Pat. No. 4,553,747 to Pursley, are very costly or limited in their versatility.

A thorough exercise program is necessary for patients with damaged muscles of the rotator cuff so that they can resume normal activities. This is especially important for athletes, both amateur and professional, and other extremely active individuals. Unless the rotator cuff is sufficiently strengthened, it is extremely susceptible to reinjury. This can lead to increased pain and loss of mobility.

Because the rotator cuff is a sensitive muscle group to exercise, precise positions and ranges of motion are needed to properly work the muscle group. The currently available equipment fails to provide necessary versatility and precision and, as previously stated, is extremely limited and very expensive. As a consequence, there is a pressing need for a more versatile and cost-effective apparatus designed specifically for working and exercising the rotator cuff in a rehabilitative and therapeutic fashion.

SUMMARY OF THE INVENTION

The present invention provides a rotator cuff rehabilitative therapeutic exercise apparatus designed to satisfy the aforementioned needs. The exercise apparatus of the present invention embodies design features which avoid the drawbacks of the prior art.

Particularly, the exercise apparatus incorporates an adjustable seat for permitting left and right arm use, a ratchet-type (toothed wheel) mechanism for allowing internal and external rotation of the arms with positive and negative work, a two-piece cam assembly with replacable cams for permitting progressive (comparative) resistance exercising tailored to particular exercises, and a two-configuration actuator mechanism which permits working of the arm at the three different positions needed for proper exercise and therapy of the rotator cuff. Also, minimum and maximum values for the human body are designed into the exercise apparatus without impacting performance. That is, persons of differing heights, weights, and arm lengths can readily use the exercise apparatus. Further, the apparatus is easily affordable and competitive with equipment currently on the market.

Accordingly, in summary, it is an object of the present invention to provide a rotator cuff exercise apparatus which has the capability for left and right arm use; to provide an exercise apparatus which permits internal and external rotation of the arms with positive and negative work; to provide an exercise apparatus which allows progressive (comparative) resistance exercising; to provide an exercise apparatus capable of working the arm at the three positions needed for proper exercise and therapy of the rotator cuff; and to provide an exercise apparatus which is competitive in cost and easily affordable. These and other objects and advantages of the present invention will become apparent: from the following detailed description, the accompanying drawings, and the appended claims.

DETAILED DESCRIPTION OF THE PREFERRED EMBODIMENT

Figure 1:
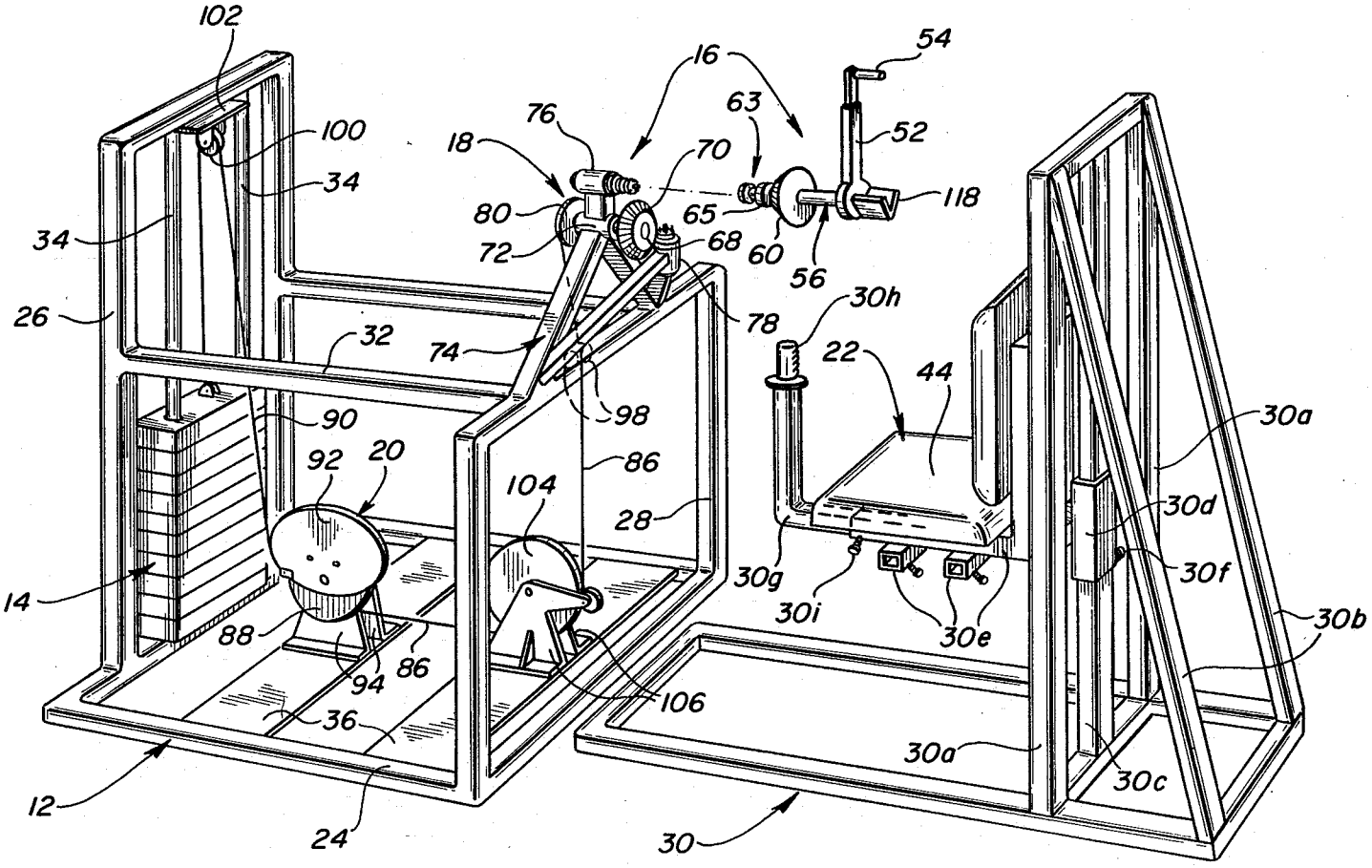
FIG. 1 is a perspective view of a rotator cuff therapeutic exercise apparatus constructed in accordance with the principles of the present invention.

Reference is made to FIG. 1 of the drawings which illustrates a rotator cuff therapeutic exercise apparatus, generally designated 10 and comprising the preferred embodiment of the present invention. In its basic components, exercise apparatus 10 includes a frame 12 having a stack of weights 14 supported thereon for movement along a working stroke from a lower rest position (seen in FIGS. 1, 3A and 3B) against gravitational force to an upper displaced position (not shown). Also, two-piece actuator mechanism 16 is provided on frame 12, being adapted to be gripped and rotated by a hand H of a user P (FIGS. 3A and 3B) to move the weights 14 along the working stroke. Actuator mechanism 16 is designed to operate in either one of a first or second configuration (FIGS. 2A and 2B) which permits a corresponding rotational working motion of the one of the user's arms A (whose hand H is gripping actuator mechanism 16) concurrently as the arm A is positioned at one of the three positions for exercising the muscles of the rotator cuff of user P.

Further for transmitting the rotational motion of the user's arm A from actuator mechanism 16 to move weights 14, a ratchet-type mechanism 18 and a two-piece cam assembly 20 are also provided on frame 12. The ratchet mechanism 18 is connected to actuator mechanism 16 and is positionable relative thereto for allowing internal and external rotation of the user's arm A and for accomplishing positive and negative work therewith. Cam assembly 20 is connected between weights 14 and ratchet mechanism 18 for permitting progressive resistance exercising tailored to particular exercises. Finally, an adjustable seat 22 assembly independent of frame 12 is provided which is adapted to position the user P for exercising either the right or left arms A.

More particularly, frame 12 of exercise apparatus 10, which mounts the other components thereof, includes a base portion 24, a forward upright portion 26, and a rearward upright portion 28. The forward and rearward upright portions 26, 28 are rigidly attached along forward and rearward ends of base portion 24 and also interconnected by cross beams 32. The forward upright portion 26 mounts a pair of laterally spaced guide rods 34 on which the weights 14 are individually mounted in a stacked fashion for generally vertical reciprocal movement therealong. Base portion 24 is thus adapted to rest on a support surface. Base portion 24 includes a pair of elongated plates 36 which extend between and are rigidly connected to opposite sides of base portion 24.

Figure 3B:
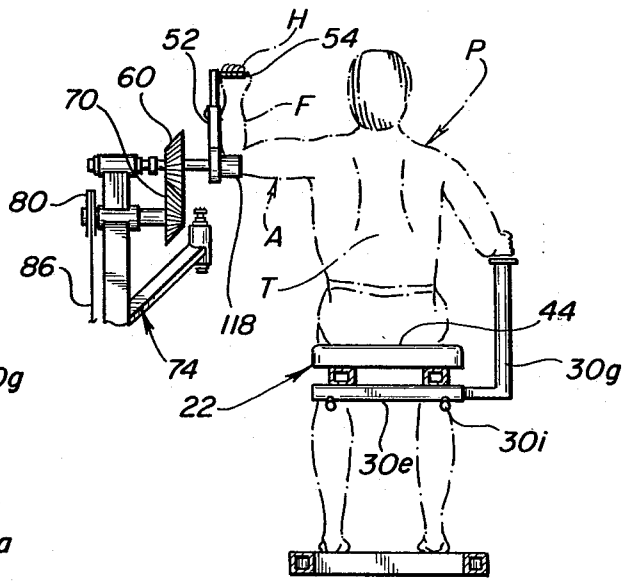
FIGS. 3A and 3B are side elevational views of the exercise apparatus of FIG. 1, illustrating a seat of the apparatus being adjusted to adapt the apparatus for use to exercise both the left and right side rotator cuff.
Figure 3A:
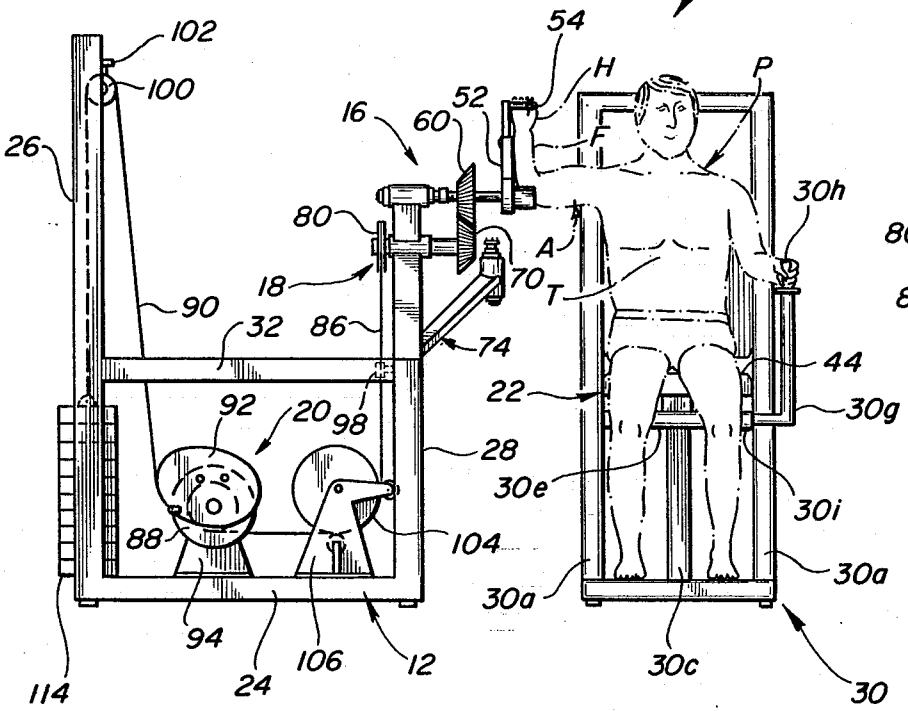

As shown in FIGS. 1 and 3A and B, adjustable seat assembly 22 of exercise apparatus 10 is mounted independently on a base 30 having an upright support frame **30*a* and laterally-extending support portions 30*b*. A generally upright post 30*c* includes a mechanism 30*d* for adjusting the height of seat assembly 22. Seat assembly 22 is adjustable for accommodating either the left or right arm A of user P as shown in FIGS. 3A and 3B. Seat assembly 22 on base 30 is free to move about on the working surface. A rigid post 30c is attached in upstanding fashion on base 30 and includes a tubular seat support frame 30*e* having a padded seat portion 44 supported on the top thereof, post 30*c* and adjustment mechanism 30*d* have a number of generally uniformly spaced holes therein permitting the adjustment of the height of seat assembly 22 by the insertion and removal of a shear pin 30*f*. Additionally, as shown in FIGS. 1 3A, and 3B, a removable tubular post 30*g* is designed to telescope into the ends of tubular seat support frame 30*e* and be held in position by pin 30*i*. On the vertical segment of post 30*g* is mounted a hand grip 30*h* which may be grasped by the user P during exercise to maintain the user's torso in a more rigid position. As can be seen, the position of post 30*g*** can be changed to accomodate different exercise positions.

Figure 2A:
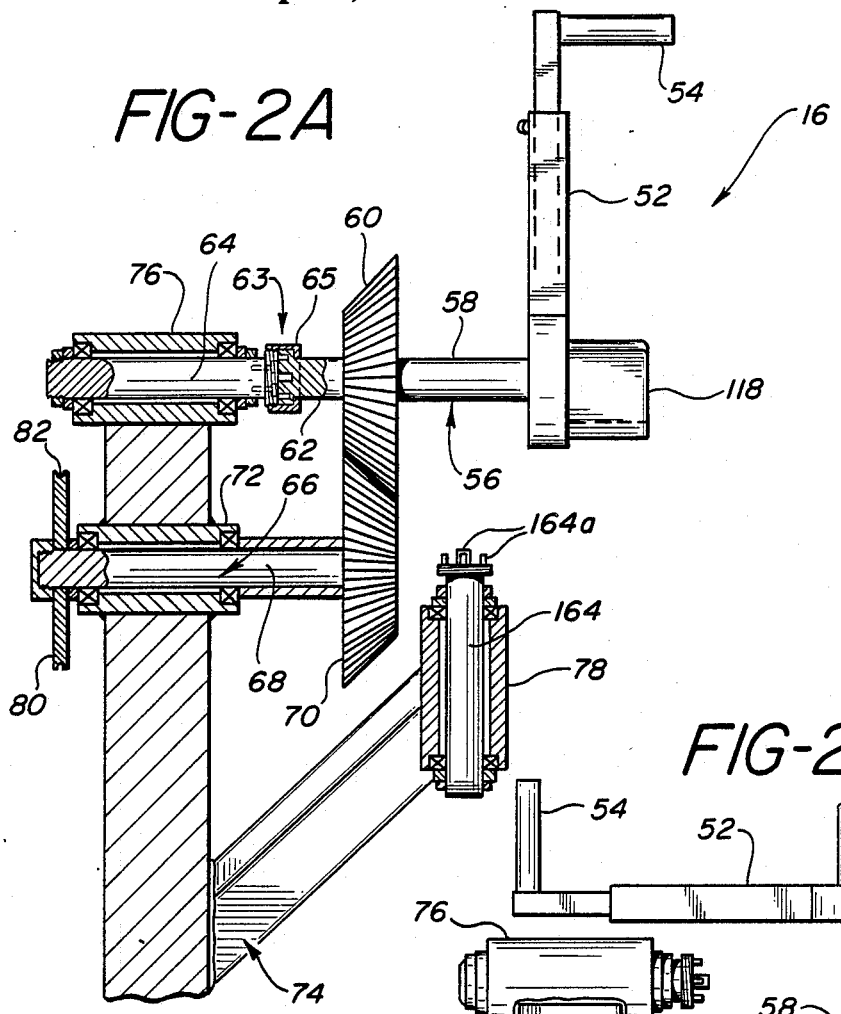
FIGS. 2A and 2B are enlarged fragmentary sectional views of the exercise apparatus of FIG. 1, illustrating the actuator mechanism of the apparatus in its two operating configurations.

Referring now particularly to FIGS. 1 and 2A and B, as briefly referred to above, actuator mechanism 16 of exercise apparatus 10 is selectively reconfigurable in either a first or second operational mode which permits a corresponding rotational working motion of the one of the user's arm A while arm is positioned at one of the three positions employed for exercising the rotator cuff of the user. The three positions for working the rotator cuff (not shown in the drawings) are 0° abduction internal and external; 90° abduction, internal and external (partially shown in FIGS. 3A and 3B); and 90° shoulder flexion, internal and external.

In the each of the three positions, arm A extends in one of three directions relative to a trunk T of the user P, namely forwardly from the trunk, laterally outward from the trunk, or downwardly along the trunk. In each position, the arm is bent approximately ninety-degrees at the elbow E (such as seen in FIGS. 3A and B) and the muscles of the rotator cuff are exercised by pivoting the forearm F, either internally (from the outside toward the inside) or externally (vice versa), about an axis extending along the respective one of the three directions.

Figure 2B:
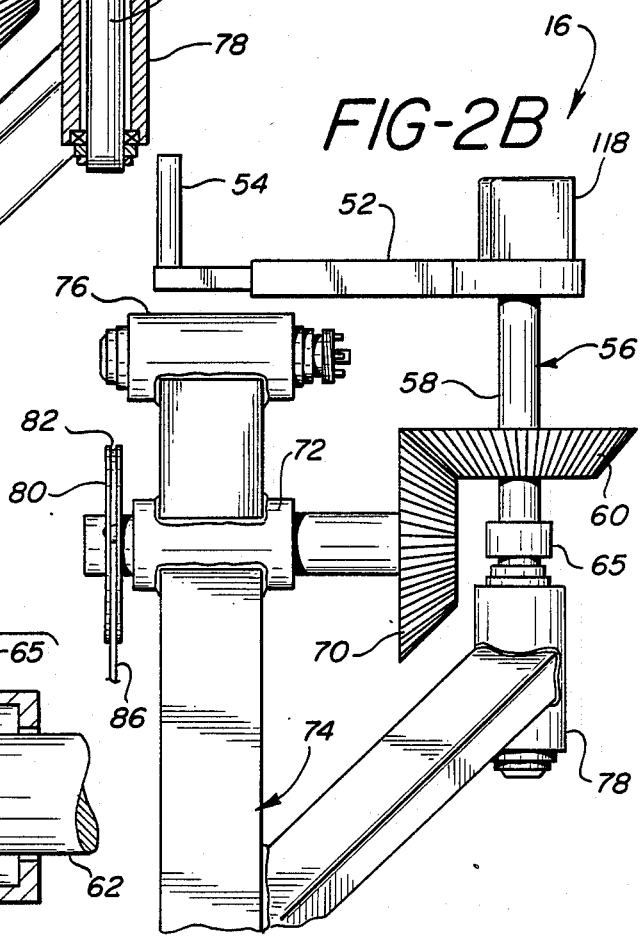

Actuator mechanism 16 includes a crank or torsion arm 52 which is rotatable in a generally vertical plane when actuator mechanism 16 is positioned in the first operating configuration shown in FIG. 2A, or in a generally horizontal plane when actuator mechanism 16 is positioned in the second operating configuration shown in FIG. 2B. Torsion arm 52 has a handle 54 mounted at its one end and a driving member 56 at its other end. Driving member 56 is in the form of an elongated shaft 58 projecting from the other end of arm 52 in a direction opposite to that of handle 54. A bevel gear 60 is mounted along shaft 58.

Figure 2C:
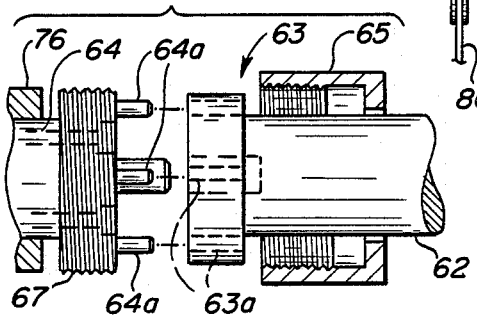
FIG. 2C is an enlarged fragmentary sectional view of the disconnect feature for the actuator mechanism shown in FIGS. 2A and 2B.

As shown in FIG. 2C, actuator mechanism 16 includes a quick disconnect and reconnect mechanism 63 for changing the configuration of the apparatus. The mechanism 63 includes an end portion 62 of shaft 58 which has an array of holes **63*a* bored therein. A permanently mounted drive shaft 64 has corresponding pins 64*a* extending from one end thereof which are adapted to mate with holes 63*a*. An internally threaded, freely rotating coupling 65 is designed to be screwed onto the externally threaded end 67 of drive shaft 64. Actuator mechanism 16 can be disconnected from the configuration shown in FIG. 2A by unscrewing coupling 65 from drive shaft 64, removing the mechanism from that position, and inserting end portion 62 into drive shaft 164 having extending pins 164*a*. Coupling 65 is then screwed on, and actuator mechanism 16 is ready for use in the configuration shown in FIG. 2B**.

Further, actuator mechanism 16 includes a driven member 66 in the form of a shaft 68 having a driven element in the form of a bevel gear 70 attached on one end of shaft 68. Shaft 68 is rotatably and stationarily mounted by a housing 72 of a superstructure 74 attached to the top of the rearward upright frame portion 28. Also, first and second receptacles or housings 76, 78 defining first and second rotational axes are attached on the frame superstructure 74. The first and second housings 76, 78 are displaced from and disposed in orthogonal relation to one another and, thus, are adapted to mount the torsion arm 52 for rotation about one or the other of the first and second axes which extend orthogonally with respect to each other. However, as seen in FIGS. 2A and B, bevel driving gear 60 of torsion arm 52 is disposed in a driving intermeshing engagement with bevel driven gear 70 of driven shaft 68 regardless to which of the housings 76, 78 the outer shaft portion 62 on torsion arm 52 is mounted. In summary, torsion arm 52 when mounted to one or the other of the first and second housings 76, 78 defines one or the other of the two operating configurations of actuator mechanism 16. It also defines one or the other of two driving orientations of bevel driving gear 60 of torsion arm 52 relative to bevel driven gear 70 of driven member 66.

Figure 4A:
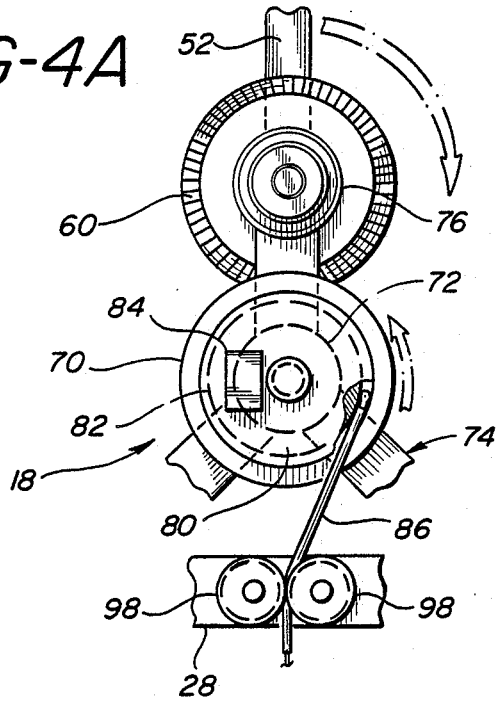
FIGS. 4A and 4B are enlarged fragmentary schematic end views of the exercise apparatus of FIG. 1, illustrating a ratchet-type mechanism which allows for positive and negative work in either clockwise or counterclockwise directions.

Turning now to specifically to FIGS. 4A and B, as briefly mentioned above, motion transmitting ratchet-type mechanism 18 of exercise apparatus 10 allows internal and external rotation of the user's arm A and accomplishing positive and negative work therewith. Ratchet mechanism 18 includes a rotatable member in the form of a circular sprocket 80 having an endless groove 82 therein and a tensioning mass 84 attached thereon offset from the rotational axis of sprocket 80. Sprocket 80 is attached on the other end of driven member shaft 68 opposite bevel driven gear 70. Thus, sprocket 80 is adapted to be rotated by rotation of the torsion arm 52 as well as shafts 58, 68 and bevel gears 60, 70 of actuator mechanism 16.

Also, ratchet type mechanism 18 includes an elongated flexible motion transmitting member in the form of a drive cable 86 interconnected at one end to the weights 14 via cam assembly 20 to be described hereinafter in detail. Drive cable 86 is attached at the other end to a location on the periphery of sprocket 80. As sprocket 80 is rotated by actuator mechanism 16 in one or the other of clockwise or counterclockwise directions, the portion of drive cable 86 extending adjacent to the other end thereof and attached to the sprocket periphery is adapted to wrap about or unwrap from the peripheral groove 82 of sprocket 80, as depicted in FIGS. 4A and B. Sprocket 80 also can be rotatably adjusted relative to the initial position of torsion arm 52 of actuator mechanism 16 between initial positions displaced approximately 180 degrees apart. In such a manner, actuator mechanism 16 is adaptable to be operated by either the left arm or the right arm of a user, or by the same arm of the user to do internal and external work.

Figure 4B:
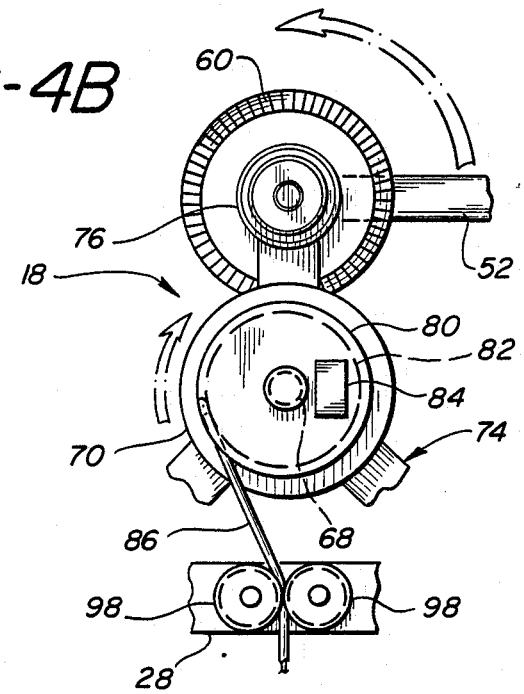
Figure 5:
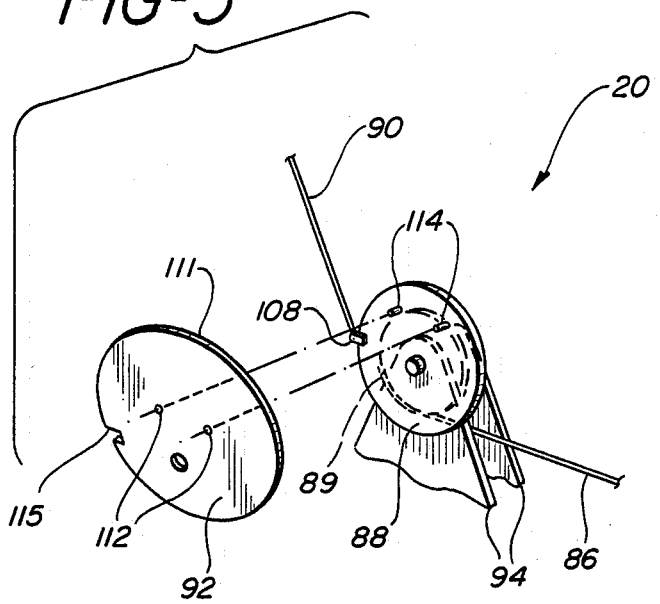
FIG. 5 is an enlarged fragmentary perspective view of the exercise apparatus of FIG. 1, illustrating a two-piece cam assembly employed in the apparatus.
Figure 6:
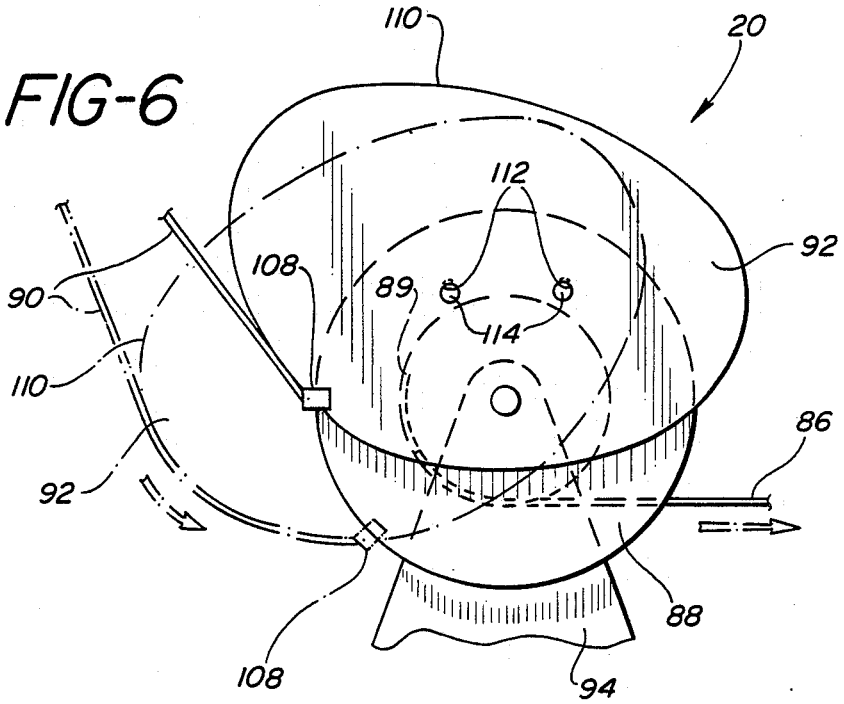
FIG. 6 is an enlarged side elevational view on a larger scale than in FIG. 5, illustrating the two angularly displaced positions of a contour cam of the two-piece cam assembly of the apparatus of FIG. 1.

Finally, turning particularly to FIGS. 5 and 6, as mentioned briefly above, the two-piece motion transmitting cam assembly 20 of exercise apparatus 10 permits progressive resistance exercising tailored to particular exercises. Cam assembly 20 includes a cam backing plate 88, a rotatable member in the form of a sprocket 89, an elongated flexible motion transmitting member in the form of a drive cable 90, and a contour cam member 92. Sprocket 89 is rotatably mounted to a pair of brackets 94 attached upright on the rear one of the frame plates 36 and has a groove 96 extending endlessly about its periphery. Drive cable 86 of ratchet mechanism 18 is atttached at its other end to a location on the periphery of sprocket 80. Between sprockets 80 and 89, drive cable 86 passes through bottom idler 104, which is rotatably mounted by a bracket 106 to the front one of the frame plates 36, and is then entrained between a pair of idler sprockets 98 which are rotatably mounted to the rearward upright frame member 28 between ratchet mechanism sprocket 80 and cam assembly sprocket 88, as shown in FIGS. 1, 4A and 4B.

The other drive cable 90 is interconnected at one end to a perforated steel shaft which is insertable in weights 14 and has a shear pin to pick up the desired number of weights 14. For severely injured patients, the weight of the drive cable alone may be utilized. From weights 14, drive cable 90 then extends over a top idler 100 rotatably mounted by a bracket 102 to the top of forward upright frame portion 26, and next downwardly to cam backing plate 88 and attaches via cable connector 108 to one side of cam backing plate 88.

Contour cam member 92 of cam assembly 20 has an eccentrically-configured periphery 110 and is removably mountable on cam backing plate 88 at the one side thereof and disposed about the central axis thereof. Other cam members having different contours, are contemplated for use in the present invention and may replace cam member 92. Cam member 92 has a pair of openings 112 defined therethrough to receive a pair of fasteners 114 projecting from the side of cam backing plate 88 for releasably attaching the cam member to the sprocket side. Further, cam member 92 includes a notch 115 which fits over cable connector 108 when the cam member is secured to cam backing plate 88. Drive cable 90 is then aligned in the same plane as the periphery of cam member 92 and wraps around he cam member as the apparatus is manipulated by the user. Although only one is shown in the drawings, a plurality of removable contour cams 92 are provided. Each cam 92 is specifically designed to impose a given progressive resistance to be used for performing a given exercise on apparatus 10.

With drive cable 90 being drawn tautly between weights 14 and cam backing plate 88, via idler 100, rotation of ratchet mechanism sprocket 80 in one or the other of the clockwise and counterclockwise directions upon rotation of actuator mechanism 16 causes corresponding rotation of cam assembly sprocket 89. Upon such clockwise or counterclockwise rotation of sprocket 89, as viewed in FIGS. 5 and 6, the other end of drive cable 86 wraps about or unwraps from groove 96 on the periphery of sprocket 89. Further, such rotation of sprocket 88 causes the other drive cable 90 of cam assembly 20 at the other end thereof to wrap about or unwrap from the periphery of cam member 92, as depicted in FIG. 6.

The rotator cuff therapeutic exercise apparatus 10 just described satisfies the many requirements for the design of a satisfactory exercise apparatus for the muscles of the rotator cuff. First, it meets the requirement that the apparatus must be usable in a multitude of ways. Both left and right arms need to be exercised. In turn, each arm needs exercising in three different positions. Each position then has both an internal and external (CCW and CW) rotation. All positions are accommodated by the provision of actuator mechanism 16, ratchet-type mechanism 18 and adjustable seat 22 of the exercise apparatus 10. Furthermore, the apparatus 10 satisfies the requirement of multiple positions with little or no redundancy in the apparatus due to the two-configuration design of actuator mechanism 16. Second, to properly work :he muscle group of the rotator cuff, progressive (comparative) resistance loading is required. All six motions associated with the three positions and external and internal rotations of the arm require different progressive resistance loading. This requirement is accommodated by the provision of cam assembly 20 and its replacable cam members 92. Third, persons differing in height, weight and length of arms can use the exercise apparatus 10.

Additionally, because of the design of exercise apparatus 10, additional exercises may be performed on the apparatus with only minor adjustments or attachments. A longer torsion arm would permit a user to strap his or her arm completely straightened into the torsion arm and exercise the muscles of the shoulder. This would open up a completely different muscle group to exercise or therapy. It should be readily appreciated that this would require a different set of contour cam members; however, this is no problem since the cam members are removable. In conclusion, the exercise of the present invention is believed to meet all design specifications without compromise for exercising the rotator cuff muscle group of a wide range of users.

Also, to assist in exercising the muscles of the rotator cuff, torsion arm 52 may have a protruding V-shaped element 118 mounted thereon for restraining movement of the elbow E of the arm A as the arm A is undergoing the rotational working motion.

Having thus described the rotator cuff therapeutic exercise apparatus of the present invention in detail and by reference to a preferred embodiment thereof, it will be apparent that certain modifications and variations are possible without departing from the scope of the invention, which is defined in the appended claims.

What is claimed is:

1. A therapeutic exercise apparatus, comprising:

a frame;

at least one weight supported on said frame for movement along a working stroke from a rest position against gravitational force to a displaced position;

an actuator mechanism mounted on said frame and adapted to be gripped and rotated by a hand of a user, said actuator mechanism being positioned in either a first or second operating configurations for permitting a corresponding rotational working motion of the one of the user's arm whose hand grips said mechanism;

means coupled to said frame and interconnecting said actuator mechanism and said weight for transmitting rotational motion of the arm of the user to said weight to move said weight along its working stroke;

said motion transmitting means including a two-piece cam assembly with replaceable cams for permitting progressive comparative resistance exercising tailored to particular exercises;

said cam assembly including a rotatable member mounted in said frame and having a central axis and a peripheral portion, a first elongated flexible motion transmitting member interconnected at one end to said actuator mechanism and attached at the other end to a location on said peripheral portion of said rotatable member such that as said rotatable member is rotated in one or the other of clockwise and counterclockwise directions by rotation of said actuator mechanism said first flexible motion transmitting member adjacent said other end thereof will wrap about or unwrap from said peripheral portion of said rotatable member, a second elongated flexible motion transmitting member interconnected at one end to said weight, extending to said rotatable member and attached at the other end to the periphery of said rotatable member, and a contour cam member having an eccentrically-configured peripheral portion and being removably mountable on said rotatable member at said one side thereof and disposed about said central axis thereof such that as said rotatable member is rotated in one or the other of clockwise and counterclockwise directions by rotation of said actuator mechanism said second flexible motion transmitting member adjacent said other end thereof will wrap about or unwrap from said peripheral portion of said cam member.

2. The exercise apparatus of claim 1 in which said actuator mechanism includes a crank arm which is rotatable when said actuator mechanism is positioned in either one of said operating configurations for working the user's arm, said crank arm having an element mounted thereon for restraining movement of the elbow of the arm as the arm is undergoing the rotational working motion.

3. The exercise apparatus of claim 1 in which said actuator mechanism includes a crank arm which is rotatable in a generally horizontal plane when said actuator mechanism is positioned in said second operating configuration.

4. The exercise apparatus of claim 1 in which said actuator mechanism includes a crank arm which is rotatable in a generally vertical plane when said actuator mechanism is positioned in said first operating configuration.

5. The exercise apparatus of claim 1 in which said actuator mechanism includes a stationarily and rotatably mounted driven member having a driven element attached thereon, a driving torsion arm having a driving element attached thereon, and first and second stationarily-mounted housings defining first and second rotational axes, said housings being displaced relative to one another and adapted to mount said torsion arm for rotation about one or the other of said first and second axes.

6. The exercise apparatus of claim 5 in which said driving element of said torsion arm is disposed in driving engagement with said driven element of said driven member when said torsion arm is mounted to either one of said housings.

7. The exercise apparatus of claim 5 in which said torsion arm when mounted to said first housing defines said first operating configuration of said actuator mechanism and one of two driving orientations of said driving element of said arm relative to said driven element of said driven member.

8. The exercise apparatus of claim 5 in which said first and second stationarily-mounted housings are disposed in orthogonal relation to one another.

9. The exercise apparatus of claim 1 further comprising a seat assembly independent of said frame which is adjustable for accommodating either the left or right arm of the user.

10. The exercise apparatus of claim 9 in which said seat assembly includes an mechanism for adjusting the height of said seat assembly.

11. The exercise apparatus of claim 1 in which said motion transmitting means includes a toothed wheel mechanism for allowing internal and external rotation of the arm and for accomplishing positive and negative work therewith.

12. A therapeutic exercise apparatus, comprising:

a frame;

at least one weight supported on said frame for movement along a working stroke from a rest position against gravitational force to a displaced position;

an actuator mechanism rotatably mounted on said frame and adapted to be gripped and rotated by a hand of a user as the one of the user's arms whose hand grips said mechanism undergoes a rotational working motion; and means coupled to said frame and interconnecting said actuator mechanism and said weight for transmitting rotational motion of the arm of the user to said weight to move said weight along its working stroke;

said motion transmitting means including a toothed wheel mechanism for allowing internal and external rotation of the arm and for accomplishing positive and negative work therewith, and a two-piece cam assembly with replaceable cams for permitting progressive comparative resistance exercising tailored to particular exercises;

said cam assembly including a rotatable member mounted on said frame and having a central axis and a peripheral portion, a first elongated flexible motion transmitting member interconnected at one end to said actuator mechanism and attached at the other end to a location on said peripheral portion of said rotatable member such that as said rotatable member is rotated in one or the other of clockwise and counterclockwise directions by rotation of said actuator mechanism said first flexible motion transmitting member adjacent said other end thereof will wrap about or unwrap from said peripheral portion of said rotatable member, a second elongated flexible motion transmitting member interconnected at one end to said weight, extending to said rotatable member and attached at the other end to the periphery of said rotatable member, and a contour cam member having an eccentrically-configured peripheral portion and being removably mountable on said rotatable member at said one side thereof and disposed about said central axis thereof such that as said rotatable member is rotated in one or the other of clockwise and counterclockwise directions by rotation of said actuator mechanism said second flexible motion transmitting member adjacent said other end thereof will wrap about or unwrap from said peripheral portion of said cam member.

13. The exercise apparatus of claim 12 in which said toothed wheel mechanism includes:

a second rotatable member having a peripheral portion and adapted to be rotated by rotation of said actuator mechanism;

said first elongated flexible motion transmitting member is attached to a location on said peripheral portion of said second rotatable member such that as said second rotatable member is rotated in one or the other of clockwise and counterclockwise directions by rotation of said actuator mechanism said first flexible motion transmitting member will wrap about or unwrap from said peripheral portion of said rotatable member.

14. The exercise apparatus of claim 13 in which second rotatable member is adjustable relative to said actuator mechanism between initial positions displaced approximately 180 degrees apart.

15. A therapeutic exercise apparatus, comprising:

a frame;

at least one weight supported on said frame for movement along a working stroke from a rest position against gravitational force to a displaced position;

an actuator mechanism mounted on said frame and adapted to be gripped and rotated by a hand of a user; and means coupled to said frame and interconnecting said actuator mechanism and said weight for transmitting rotational motion of the arm of the user to said weight to move said weight along its working stroke;

said motion transmitting means including a two-piece cam assembly with replaceable cams for permitting progressive comparative resistance exercising tailored to particular exercises;

said cam assembly including a rotatable member mounted on said frame and having a central axis and a peripheral portion, a first elongated flexible motion transmitting member interconnected at one end to said actuator mechanism and attached at the other end to a location on said peripheral portion of said rotatable member such that as said rotatable member is rotated in one or the other of clockwise and counterclockwise directions by rotation of said actuator mechanism said first flexible motion transmitting member adjacent said other end thereof will wrap about or unwrap from said peripheral portion of said rotatable member, a second elongated flexible motion transmitting member interconnected at one end to said weight, extending to said rotatable member and attached at the other end to the periphery of said rotatable member, and a contour cam member having an eccentrically-configured peripheral portion and being romovably mountable on said rotatable member at said one side thereof and disposed about said central axis thereof such that as said rotatable member is rotated in one or the other of clockwise and counterclockwise directions by rotation of said actuator mechanism said second flexible motion transmitting member adjacent said other end thereof will wrap about or unwrap from said peripheral portion of said cam member.

16. The exercise apparatus of claim 15 in which said cam member has a slot defined on the periphery thereof adapted to receive said member and member connector so as to align said second flexible member secured to said rotatable member by said member connector with said peripheral portion of said cam member when said cam member is removably mounted on said side of said rotatable member.

* * * * *